US006023601A

United States Patent [19]

Hirosaki et al.

[11] Patent Number: 6,023,601

[45] Date of Patent: Feb. 8, 2000

[54] DEVELOPING DEVICE USING TWO-COMPONENT DEVELOPER

[75] Inventors: Satoru Hirosaki; Nobumasa Furuya; Takuto Tanaka, all of Nakai-machi, Japan

[73] Assignee: Fuji Xerox Co., Ltd., Tokyo, Japan

[21] Appl. No.: 09/244,567

[22] Filed: Feb. 10, 1999

[30] Foreign Application Priority Data

Mar. 13, 1998 [JP] Japan ..... 10-083036

[51] Int. Cl.[7] ..... G03G 15/09

[52] U.S. Cl. ..... 399/277

[58] Field of Search ..... 399/267, 277; 430/122

[56] References Cited

U.S. PATENT DOCUMENTS 5,149,914 9/1992 Koga et al. ..... 399/270
5,799,234 8/1998 Furuya et al. ..... 399/277

FOREIGN PATENT DOCUMENTS 62-201463 9/1987 Japan .
7-333993 12/1995 Japan .
9-90760 4/1997 Japan .
9-269661 10/1997 Japan .

*Primary Examiner*—Joan Pendegrass
*Attorney, Agent, or Firm*—Oliff & Berridge, PLC

[57] ABSTRACT

In a developing device for visualizing an electrostatic latent image using two-component developer containing toner and magnetic carrier, excellent development will be performed and deterioration of the developer will be prevented. A developer carrier opposite to an image carrier having an electrostatic latent image formed thereon is prepared by forming a thin layer of aluminum with a thickness of 3 $\mu$m or less on the peripheral surface of a roll-shaped member made of ferrite, and the surface roughness Rz of the peripheral surface of the foregoing ferrite roll is set to 50 $\mu$m or less. N-poles and S-poles are alternately magnetized at a 50-to-250-$\mu$m pitch along the peripheral surface of this ferrite roll. These magnetic poles can be magnetized to have uniform intensity because the peripheral surface of the roll has been smoothly finished, and a developer layer having only substantially one layer of the carrier uniformly attracted is formed on the peripheral surface. On the other hand, a magnetic recording layer is provided on a roll-shaped conductive substrate, and its surface may be finished so as to satisfy relation of Rz≦50 $\mu$m. At this time, the thickness of the magnetic recording layer is desirably set to 200 $\mu$m or less.

18 Claims, 3 Drawing Sheets

DEVELOPING DEVICE USING TWO-COMPONENT DEVELOPER

BACKGROUND OF THE INVENTION

1. Detailed Description of the Invention

2. Technical Field of the Invention

The present invention relates to a developing device for use in an electrophotographic recording apparatus, an electrostatic recording apparatus or the like, for selectively transferring toner onto a latent image based on an electrostatic potential difference for visualizing, and more particularly, to a developing device using two-component developer having carrier and toner mixed together.

Description of Prior Art

As an image forming apparatus for a copying apparatus, a printer and the like, an apparatus of the electrophotographic type or the electrostatic recording type has been widely used. Such an apparatus has been constructed so that a latent image based on an electrostatic potential difference is formed on an image carrier, toner is transferred onto this latent image to form a visible image, and thereafter, this toner image is transferred onto a recording sheet or the like.

As a developing device for visualizing an electrostatic latent image on the foregoing image carrier, there is a so-called two-component developing device for causing two-component developer consisting of toner and magnetic carrier to come into contact with or approach the surface of an image carrier and transferring toner for development. This developing device has problems that it is necessary to control the density of toner in the developer, and that carrier must be periodically replaced with degradation in the charging ability thereof in addition to replenishment of toner, though it has excellent characteristic properties in terms of image qualities, conveying property of developer and the like, and has mainly been used.

Such a developing device has a developer carrier equipped with, for example, a magnet roll and a sleeve which is rotationally driven around the magnet roll, and is adapted to carry developer on this developer carrier for conveying the developer to the position where the developer carrier faces the image carrier, and to transfer toner onto a position corresponding to a latent image on the image carrier.

Since the amount of developer on the developer carrier significantly affects not only the image density but also other image qualities, a developer layer with a predetermined thickness is adapted to be formed ebfore facing the image carrier.

As a layer forming method for forming a developer layer with a predetermined thickness on a developer carrier, there are a technique of regulating to a desired layer thickness using a layer regulating member such as a trimmer or a blade for uniformalization, a technique of causing two rolls to come into contact with each other in a rotating state respectively for thereby obtaining a developer layer with a stable thickness on these rolls as disclosed in Japanese Published Unexamined Patent Application No. 7-333993, and the like.

In the case of forming a layer using such a layer regulating member as a trimmer and a blade, however, at the front portion of the layer regulating member, i.e., on the upstream side in the developer conveying direction, a strong compressive force acts on the developer because it enters a state in which it has excessively been filled with the developer, and a strong frictional force acts on the developer when it is passing through the clearance between the layer regulating member and the developer carrier, leading to a problem that the developer is deteriorated in the layer regulating portion.

The foregoing deterioration of the developer is broadly divided into deterioration of toner and deterioration of carrier, and both are caused by a compressive force, a frictional force or the like. When toner is deteriorated, the amount of charge of toner becomes unstable, and toner with a low amount of charge and reverse-polar toner are caused to generate fog on the background portion. Also, since the adhesive force between toner and carrier increases, the toner becomes hard to be peeled from the surface of the carrier, and the amount of toner to be developed decreases to lower the image density. On the other hand, even when carrier is deteriorated, the amount of charge of the toner decreases to cause fog on the background portion.

The other problems for a two-component developing device using the layer regulating member are as follows:

In the case of using a layer regulating member (trimmer) consisting of non-magnetic or magnetic material, since the amount of conveying the developer depends upon the clearance between the layer regulating member and the surface of the developer carrier as well as the positional relations of magnetic poles of the developer carrier, the dimensional precision and setting precision of the layer regulating member significantly influence the image quality. Therefore, in order to obtain an excellent image, it is necessary to set the foregoing clearance to extremely high precision. For this reason, it takes a lot of time and labor to fabricate and install the layer regulating member, leading to increase of manufacturing cost.

On the other hand, a technique of developing an electrostatic latent image using a magnetic brush while rotating a developer carrier consisting of a permanent magnet member alone by omitting the sleeve which constitutes the developer carrier has been disclosed in Japanese Published Unexamined Patent Application Nos. 62-201463 and 9-90760.

According to the developing method specified in the Japanese Published Unexamined Patent Application No. 62-201463, a magnetic brush consisting of magnetic developer is formed to cause about a half the height of this magnetic brush to come into contact with the image carrier. Also, in the technique described in the Japanese Published Unexamined Patent Application No. 9-90760, it has been proposed to form a developer roll by a permanent magnet member integrally formed in a cylindrical shape with a pitch between magnetic poles on the surface in the circumferential direction of 0.5 to 10 mm, the surface magnetic flux density of 100 to 1200 G, and the diameter of 10 to 20 mm, to coat the surface with a resin layer containing a conductive agent, and to form this resin layer to have a thickness of 1 to 10 $\mu$m, volumetric resistivity of $10^{-1}$ to $10^{4}$ $\Omega\cdot$cm, and surface roughness (RZ) of 0.1 to 10 $\mu$m.

In such a magnetic brush developing system with the sleeve omitted as described above, however, there occurs a difference in the height of the magnetic brush between on the magnetic poles and magnetic pole-to-magnetic pole of the permanent magnet member, and variation occurs in the development characteristic property. For this reason, uneven density corresponding to the height of the magnetic brush occurs in a toner image developed.

Such uneven density can be eliminated by increasing the number of revolutions of the permanent magnet member, but to achieve this object, it is necessary to increase the driving torque, and there arises a problem that noise will be newly generated with the increase in the driving torque.

Such being the case, in Japanese Published Unexamined Patent Application No. 9-269661, there has been disclosed a developing device for forming a developer layer on a developer carrier without the aid of any layer regulating member with the provision of magnetic poles, which substantially uniformly attract a developer layer of substantially one layer, on the peripheral surface of the developer carrier. In other words, by means of the interval between magnetic poles magnetized on the peripheral surface of the developer carrier and their intensity of magnetization, there is formed a developer layer, to which carrier of substantially one layer, which has not such chain structure as a conventional magnetic brush, has been magnetically attracted. The developer layer circumferentially moves together with the magnetic poles to be conveyed to a portion opposite to the image carrier. In a developing device constructed as described above, it is possible to resolve the deteriorated developer due to the layer regulation, and at the same time, the developer layer on the developer carrier becomes substantially uniform, and variation in the height of the developer layer corresponding to the interval between magnetic poles is eliminated, thus making it possible to reproduce a uniform image without uneven density.

Problems to be Solved by the Invention

However, the developing device disclosed in the Japanese Published Unexamined Patent Application No. 9-269661 has the following problems.

In order to form a uniform developer layer having only one layer of carrier attracted thereto, on the developer carrier as described above, the plurality of magnetic poles must be magnetized at infinitesimal intervals on the peripheral surface of the developer carrier or in the vicinity thereof so that their intervals and the magnetic flux density of each magnetic pole become substantially uniform. If they are not uniform, there will occur both portions to which carrier is attracted and portions to which carrier is not attracted, resulting in uneven density on an image developed or deteriorated reproducibility of thin lines.

Since, however, the intervals of magnetization are infinitesimal, the residual magnetic flux density on the surface of the developer carrier will become uneven if the abutted state between the magnetizing head and the magnetized surface of the developer carrier fluctuates. In other words, a clearance appears between the magnetizing head and the magnetized surface of the developer carrier, and when this clearance fluctuates, there is a problem that magnetization tends to become uneven.

The present invention has been achieved in the light of the foregoing problems, and is aimed to provide a developing device capable of performing excellent development by forming a uniform thin layer of two-component developer on the peripheral surface of the developer carrier, and preventing the two-component developer from being deteriorated.

SUMMARY OF THE INVENTION

Method for Solving the Problems

In order to solve the foregoing problems, there is provided, according to the invention, a developing device, comprising a developer carrier, provided in proximity to or in contact with an image carrier on whose surface an electrostatic latent image is formed, and supported so that the peripheral surface can rotate, for applying developing bias voltage between the developer carrier and the foregoing image carrier, and transferring toner from two-component developer containing toner and magnetic carrier, carried on the peripheral surface of the foregoing developer carrier, onto the foregoing image carrier to thereby form a toner image, wherein the foregoing developer carrier is either constituted of ferromagnetic material in the vicinity of the peripheral surface thereof or has a magnetic recording layer in the vicinity of the peripheral surface, the peripheral surface of a portion constituted of this ferromagnetic material or the surface of the magnetic recording layer is finished so that the surface roughness Rz becomes 50 $\mu$m or less, N-poles and S-poles are alternately magnetized on the portion constituted of this ferromagnetic material or the magnetic recording layer over the entire circumference of the developer carrier, and the center-to-center spacing between an N-pole and an S-pole which are adjacent to each other on the developer carrier is from 25 $\mu$m to 250 $\mu$m.

The invention assumes that in a developing device specified above, the peripheral surface of a portion constituted of the ferromagnetic material in the vicinity of the foregoing peripheral surface or the surface of the foregoing magnetic recording layer is finished so that the surface roughness Rz exceeds 1 $\mu$m, and a conductive layer with a thickness of about 3 $\mu$m or less is stacked on top thereof.

The invention assumes that in a developing device specified above, the foregoing developer carrier is a carrier prepared by stacking a magnetic recording layer on the peripheral surface of a roll-shaped member formed of conductive material or a roll-shaped member formed of conductive material in the vicinity of the peripheral surface, and the thickness of the magnetic recording layer is about 200 $\mu$m or less.

The invention assumes that in a developing device specified above, the portion of the foregoing developer carrier, constituted of ferromagnetic material, or the magnetic recording layer possesses electrical conductivity.

Operation

A developing device according to the present invention is constructed as described above to thereby operate as below.

A developer carrier of this developing device can be made into magnetic poles arranged at equal intervals, having uniform intensity even if they are magnetized at as infinitesimal intervals as 25 $\mu$m to 250 $\mu$m because the surface of the portion formed by the ferromagnetic material in the vicinity of the peripheral surface or the magnetic recording layer is smoothly finished, the surface roughness Rz is 50 $\mu$m or less, and a plurality of magnetic poles are provided there. In other words, if the surface of the portion formed by the ferromagnetic material or the magnetic recording layer has projections and depressions, clearance occurs between the magnetizing head and the surface, and its magnitude fluctuates when each magnetic pole is magnetize d, whereby the intensity of magnetization becomes uneven for each of these magnetic poles. If, however, the surface of the portion formed by the foregoing ferromagnetic material or the magnetic recording layer is set so as to satisfy relation of $Rz \leqq 50$ $\mu$m, the positional relationship between the magnetizing head and the surface of an object to be magnetized is stabilized, and the magnetic poles are formed substantially uniformly. The plurality of magnetic poles are magnetized to have uniform intensity at equal intervals of 25 $\mu$m to 250 $\mu$m as described above, whereby only substantially one layer of generally-used carrier with a particle diameter of 25$\mu$m to about 200 $\mu$m is uniformly attracted closely on the peripheral surface of the developer carrier. Thus, such a developer layer is caused to face the image carrier for development, whereby it becomes possible to reproduce an image with high image quality.

A reason why a uniform developer layer having only one layer of carrier attracted is formed as described above can be considered as below.

Magnetic lines of force caused by magnetic poles arranged at as narrow intervals as 25 μm to about 250 μm are directed towards the adjacent magnetic pole having different polarity, and therefore, the magnetic field component in a direction perpendicular to the surface of the developer carrier abruptly attenuates in the vicinity of the surface of the developer carrier. Also, when a layer of the carrier is formed on the peripheral surface, the magnetic lines of force pass through the interior of the layer of carrier in contact with the peripheral surface of the developer carrier, and are hardly distributed in the outside thereof. Therefore, the carrier does not concentratedly adhere to portions on the magnetic poles, but only substantially one layer is attracted in a systematically-arranged state along the magnetic field. Therefore, substantially one uniform developer layer is formed on the developer carrier. Since the interval between the magnetic poles has been set to be sufficiently narrow in this way, no influence caused by the magnetic pole pattern occurs, and an image with high level of uniformity can be obtained.

The magnetic carrier on such developer carrier forms a closed magnetic circuit-shaped bridge between two adjacent magnetic poles. Therefore, a strong magnetic constraint force acts on the carrier layer on the developer carrier, and individual magnetic carrier particles are conveyed while they are being attracted on the peripheral surface of the developer carrier, in a state where they are not relatively moving to this peripheral surface, in other words, without jumping, rolling or being agitated on the peripheral surface of the developer carrier. Therefore, neither flying of the developer nor adhesion of the carrier onto the image carrier occurs.

Further, at a position where the image carrier and the developer carrier oppose to each other, the carrier enters a substantially fixed state on the peripheral surface of the developer carrier by the magnetic constraint force, and does not come into contact with the image carrier, and therefore, the carrier does not mechanically slidably contact the surface of the image carrier. Accordingly, it becomes possible to reproduce a high-quality image free from image-quality defects such as brush marks.

Also, in such a developing device as described above, only the operation of magnetic poles provided on the developer carrier forms a thin layer of the developer, and any excessive burden of the layer regulating member and the like on the developer is avoided. Therefore, the developer is prevented from being deteriorated and it becomes possible to form a stable image which does not vary with time because the amount of developer conveyed does not depend upon the part precision.

The foregoing developer carrier is, as specified above, made into a developer carrier having a conductive layer stacked on the magnetic recording layer, whereby there is formed an electric field caused by developing bias voltage applied between this conductive layer and the conductive substrate of the image carrier, and the toner can be effectively reciprocated.

Also, since the thickness of the conductive layer is 3 μm or less and the magnetic field formed by the magnetic recording layer hardly attenuates even in the vicinity of the developer carrier, the carrier magnetically attracted on the surface of the developer carrier can be prevented from being transferred onto the image carrier and flying.

Further, when, as the foregoing developer carrier, a magnetic recording layer is formed on the peripheral surface of a roll-shaped member made of conductive material, as specified, above, or a magnetic recording layer is formed on the peripheral surface of a roll-shaped member having a layer made of conductive material in the vicinity of the peripheral surface, it is possible to magnetically hold the carrier on the surface of the developer carrier by means of a magnetization pattern formed on this magnetic recording layer, for conveying it to the opposite portion to the image carrier. Also, it is possible to perform the development by applying developing bias voltage between the image carrier and a portion made of conductive material located beneath this magnetic recording layer. Thus, the layer thickness of this magnetic recording layer is set to about 200 μm or less, whereby an effective development field is formed between this developer carrier and the image carrier, and transfer of toner from the developer carrier to the image carrier is furthered by this electric field so that excellent development is performed.

Also, when a portion of the foregoing developer carrier constituted of ferromagnetic material or a magnetic recording layer possessing electrical conductivity is used as specified, above, it is possible to apply bias voltage between this ferromagnetic material or the magnetic recording layer and the image carrier, an effective development field is formed between the image carrier and the developer carrier, and transfer of toner from the developer carrier to the image carrier is furthered. Also, it is possible to maintain the development of high image quality without uneven density by forming a magnetic field, which magnetically attracts substantially one layer of carrier, in the vicinity of the peripheral surface of the developer carrier.

DETAILED DESCRIPTION OF PREFERRED EMBODIMENTS

EMBODIMENTS OF THE INVENTION

Hereinafter, a description will be made of developing devices according to embodiments of the present invention.

First Embodiment

<a. Structure and Operation of Developing Device>

Figure 1:
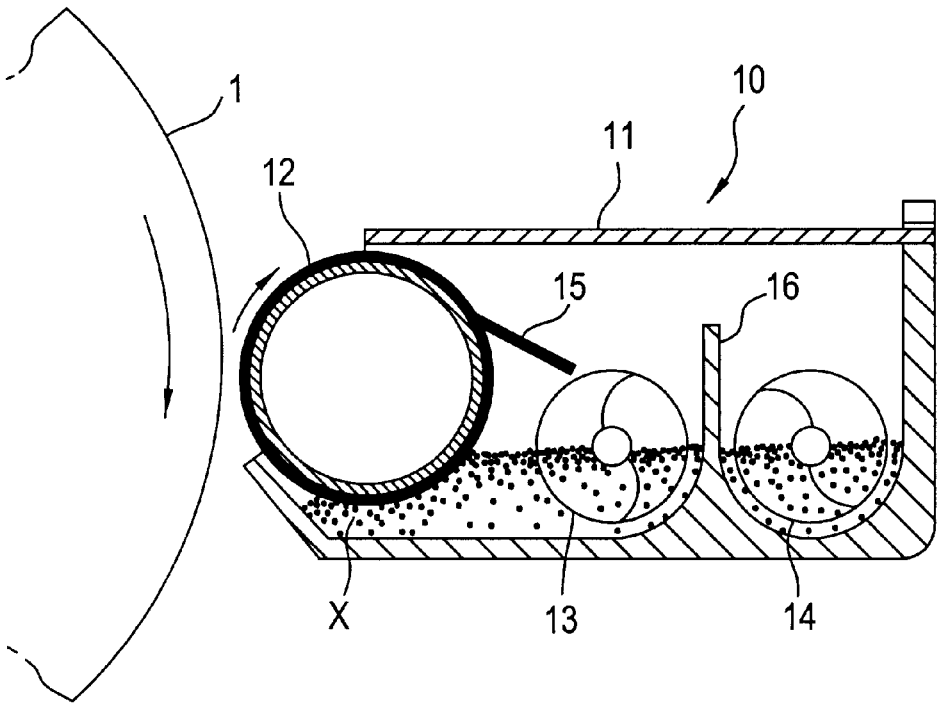
FIG. 1 is a schematic structural view showing a developing device according to an embodiment of the invention.

FIG. 1 is a schematic structural view showing a developing device according to an embodiment of the present invention.

This developing device 10 is constructed so that there is provided an opening for development at a position opposite of a housing 11 containing developer therein to an image carrier 1, a developer carrier 12 is disposed in this opening, and there are provided two screw augers 13 and 14 behind the opening. Also, a scraper 15 for peeling developer adhered onto the developer carrier 12 is provided so as to come into contact with the developer carrier 12.

The foregoing screw augers 13 and 14 are provided within two developer agitating/conveying chambers partitioned by a partition wall 16 within the housing, and are rotationally driven so as to convey the developer in the directions opposite to each other respectively. The foregoing two developer agitating/conveying chambers are conductively connected at both ends so that the developer conveyed by the foregoing screw augers 13 and 14 is circulated within these two developer agitating/conveying chambers while being agitated.

Figure 2:
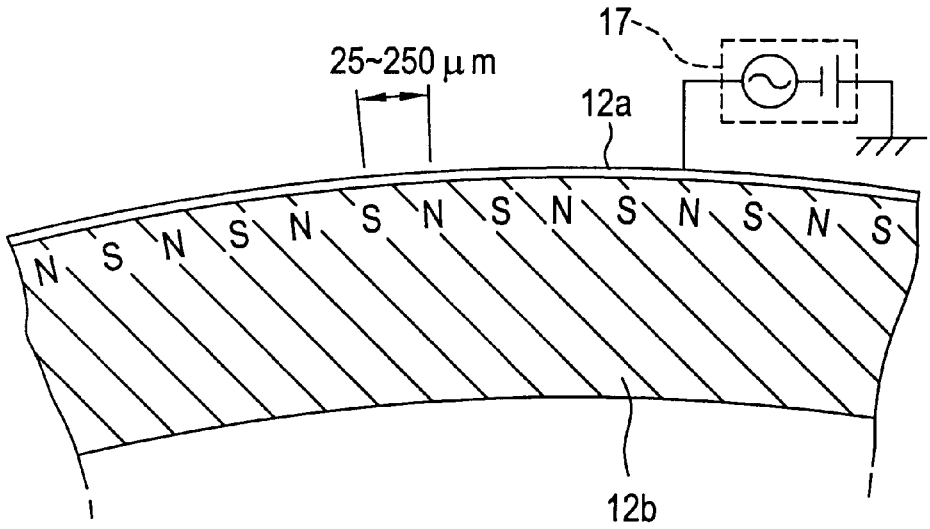
FIG. 2 is a partially enlarged sectional view showing a developer carrier for use in the developing device shown in FIG. 1.

The foregoing developer carrier 12 is supported so as to rotate about the shaft line, and its main portion is constituted of a roll-shaped member 12*b* made of ferrite and a conductive layer 12*a* formed on the peripheral surface thereof as shown in FIG. 2. This developer carrier 12 has an outside diameter of 18 mm and a peripheral speed during driving of 320 mm/s. The clearance between the developer carrier 12 and the image carrier 1 is set to 300 μm, and the developer layer is held so as to be in a non-contact state with the image carrier 1.

The foregoing conductive layer 12*a* is a thin layer of aluminum with a thickness of about 2 μm, and developing bias voltage is applied to the conductive layer 12*a* by developing bias power supply 17. For this developing bias voltage, AC voltage with DC voltage superimposed thereon is adopted, and the DC component is set to −400 V in order to prevent ground fog from occurring.

When the frequency is too low, the AC component of the developing bias voltage causes density unevenness in conformity with the frequency of the developing bias on the image, and when the frequency is too high, the motion of toner cannot follow a change in the electric field, and the developing efficiency lowers. On the other hand, when the peak-to-peak voltage of the AC bias is too low, the developing efficiency lowers because no sufficient electric field acts on the toner, and when the peak-to-peak voltage is too high, fog on the background portion or adhesion of carrier onto the photoreceptor is prone to occur.

In terms of the foregoing, the frequency is preferably set to a range of 0.4 to 10 kHz, and the peak-to-peak voltage, to a range of 0.8 to about 3 kV. In the present embodiment, the AC component of the developing bias voltage was set to peak-to-peak voltage of 1.5 kV in a square wave having frequency of 6 kHz.

On the other hand, the foregoing roll-shaped member 12*b* of ferrite is finished so that the surface roughness Rz is 50 μm or less, and on the its peripheral surface, S-poles and N-poles are alternately magnetized at equal intervals (25 to about 250 μm) in the circumferential direction. Such magnetic poles are provided over the entire circumference, and are magnetized so as to have substantially uniform magnetic flux density in the axial direction of this developer carrier. In this respect, the magnetization will be described later.

Developer used in the foregoing developing device is two-component developer having non-magnetic toner and magnetic carrier mixed together, and for the toner, negatively chargeable polyester toner with a weight-average particle diameter of 7 μm is used. For the carrier, there is used so-called magnetic powder dispersion resin carrier, having magnetic powder dispersed in binding resin, with a weight-average particle diameter of 100 μm, having true density of 2.2 g/cm$^3$ and magnetization per unit weight of 40 A·m$^2$/kg. The toner/carrier mixing ratio is 15 wt. %, and is adjusted in such a manner that the amount of charge of toner is within a range of −15 mC/kg to −20 mC/kg.

In this respect, the foregoing magnetization per unit weight is the value in a magnetic field of $10^6/(4\pi)$ A/m.

In such a developing device 10, the developer, which has been sufficiently agitated by the screw augers 13 and 14, comes into contact with the developer carrier in an area X indicated in FIG. 1, and is supplied on the developer carrier 12. By means of a magnetic field formed by the magnetic poles magnetized along the peripheral surface, a fixed amount of developer is attracted on the peripheral surface of the developer carrier 12. More specifically, the peripheral surface of the developer carrier is smoothly finished and magnetic poles having uniform intensity are formed at infinitesimal regular intervals, and therefore, only substantially one layer of magnetic carrier, which has electrically attracted toner, enters a substantially uniformly adhered state to form a developer layer without the aid of any layer regulating member. Thus, this developer layer is conveyed to the development area opposite to the image carrier 1 with the rotation of the developer carrier 12 to be used for development of an electrostatic latent image on the image carrier 1.

In this respect, in this developing device, the developer carrier 12 is mainly constituted of a roll-shaped member of ferrite and a thin layer of aluminum, but embodiments of the present invention are not limited to these structure and material, and there may be used a roll-shaped member made of another ferromagnetic material in place of ferrite. Also, as the conductive layer, a thin layer made of another conductive metal such as nickel may be used.

<b. Magnetizing Method>

Next, a description will be made of a method for magnetizing the foregoing roll-shaped member 12*b* of ferrite.

Figure 3:
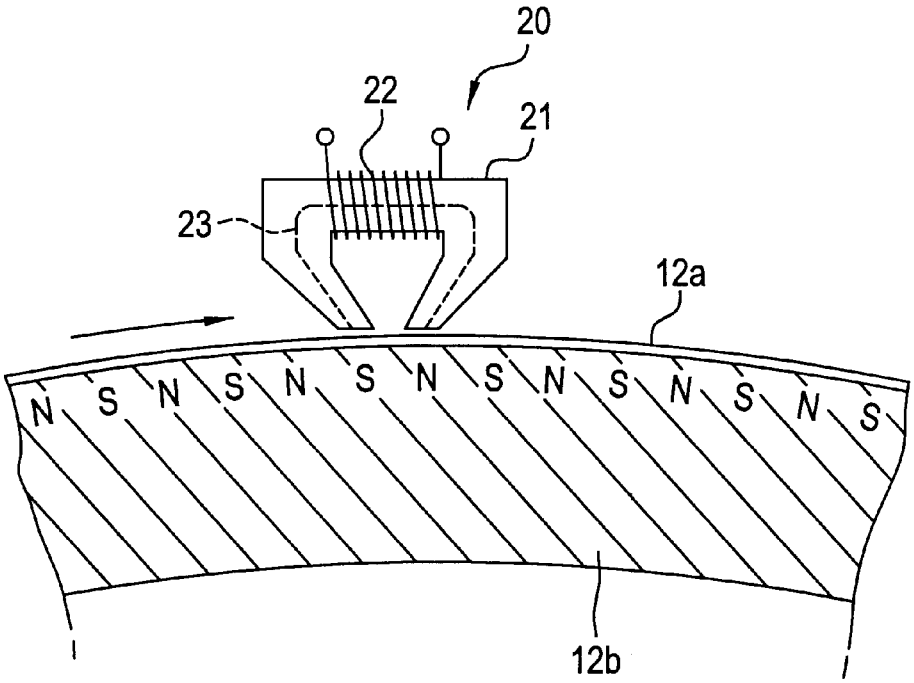
FIG. 3 is a view showing an example of a magnetizing method for the developer carrier shown in FIG. 2.

The roll-shaped member 12*b* is, as shown in FIG. 3, magnetized by a magnetic recording head 20 arranged in proximity to the peripheral surface of the developer carrier 12.

This magnetic recording head 20 is made of mild magnetic material, has a core 21 of such a shape that both end portions are arranged at a spacing in parallel manner, and a coil 22 wound around this core 21, and is arranged so that the both end portions of the foregoing core 21 are positioned close to, or abut upon the peripheral surface of the developer carrier. To the coil 22, magnetization current is adapted to be supplied from power supply (not shown) controlled by a magnetization signal generator. When current flows through the coil 22, magnetic flux 23 is generated within the core 21, and this magnetic flux 23 passes through the roll-shaped member 12*b* of ferrite from the tip ends of the core 21. This magnetic flux magnetizes the roll-shaped member 12*b*. Magnetization current supplied to the coil 22 is supplied intermittently or appropriately changing the direction of the current on the basis of a signal from the magnetization signal generator so that the peripheral surface of the developer carrier 12 rotationally driven as shown in FIG. 3 is magnetized to a predetermined magnetization pattern. In the present embodiment, alternate magnetization of N-poles and S-poles is performed in accordance with a sine wave pattern in the circumferential direction of the developer carrier 12, and the peak value of the magnetic flux density on the surface of the developer carrier in the radial direction is set to 50 mT.

<c. Experiments for Investigating Relation between Surface Roughness of Developer Carrier and Coverage of Developer, and Relation with State of Image>

Next, in the developing device shown in FIG. 1, a description will be made of an experiment for investigating the effect on the coverage of developer by varying the surface roughness of the roll-shaped member of ferrite, and an experiment for investigating the uniformity of density of an image to be developed and the reproducibility of thin lines by varying the surface roughness of the roll-shaped member used as the developer carrier in this way.

In the developing device used in these experiments, as the developer carrier, an aluminum layer with a thickness of 2 μm each was formed on five types of ferrite rolls having surface roughness Rz of 5 μm, 12 μm, 30 μm, 50 μm and 70 μm for the use.

The interval between magnetic poles magnetized on the foregoing ferrite roll is set so that the interval on the surface of the developer carrier is 100 μm, and all the ferrite rolls were magnetized by the use of the magnetic recording head 20 shown in FIG. 3.

For the developer, there was used a mixture of the foregoing negatively-chargeable polyester toner and the foregoing magnetic powder dispersion resin carrier.

Figure 4:
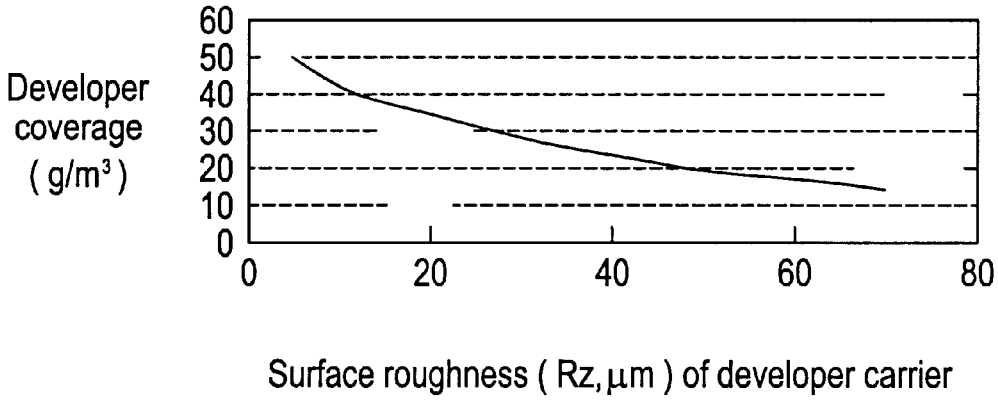
FIG. 4 is a view showing the relationship between the developer coverage and the surface roughness (Rz) of a magnetized portion of the developer carrier for use in the developing device shown in FIG. 1.

In the foregoing developing device, the coverage of developer supplied on the developer carrier was obtained by weighing the developer attracted per unit area on the peripheral surface of the developer carrier, and this measured result is shown in FIG. 4.

As will be clear from FIG. 4, the larger is the surface roughness (Rz) on the magnetized portion of the developer carrier, the more the developer coverage on the surface thereof decreases. This is presumed to be because the larger the surface roughness (Rz) is, the stability of the state when the magnetic recording head 20 and the developer carrier 12 oppose to each other becomes worse, and the magnetic flux density formed on the developer carrier becomes uneven.

Next, a description will be made of the experimental result obtained by investigating the effect of the surface roughness (Rz) on the magnetized portion of the developer carrier on the image uniformity and thin line reproducibility.

In this experiment, ferrite rolls having different surface roughness (Rz) were used as the developer carrier, and an image was formed for each of them to investigate the uniformity of image density and the reproducibility of thin lines. The result of the experiment is shown in Table 1.

The uniformity of the image was evaluated by visual inspection for solid images, and a state in which density unevenness cannot be confirmed was regarded as A, a level at which there is no problem in practical use although there is a small amount of density unevenness, as B, and a unusable level, as C.

As regards the reproducibility of thin lines, line images with a width of 130 μm were evaluated by visual inspection, and a state in which nicks at edge portions and density unevenness cannot be confirmed was regarded as A, a level at which there is no problem in practical use although there are a small amount of nicks and density unevenness, as B, and a unusable level, as C.

TABLE 1

| Surface roughness (R %) | Uniformity | Thin lines |
|---|---|---|
| 5 μm | A | A |
| 12 μm | A | A |
| 30 μm | A | A |
| 50 μm | B | B |
| 70 μm | C | C |

Setting the surface roughness Rz of the developer carrier to 50 μm or less as shown in Table 1 allows an image excellent in uniformity of image density and reproducibility of a thin line image to be formed.

<d. Experiments for Investigating Effects of Thickness of Conductive Layer on Image Density, Carrier Adhesion, Uniformity of Image in Low-Density Portion and Thin line Reproducibility>

In the developing device shown in FIG. 1, a description will be made of experiments for forming an image by varying the thickness of the conductive layer provided on the surface of the developer carrier to investigate the image density, the adhesion of carrier onto the image carrier (hereinafter, referred to as carrier adhesion), the uniformity of the image in the low density portion, and the reproducibility of the thin-line image.

In the developer carrier used for these experiments, the thickness of the conductive layer was set to three kinds: 1 μm, 3 μm and 5 μm, the magnetic pole interval on the surface of the developer carrier was set to 100 μm, and the peak value of the magnetic flux density on the surface of the developer carrier in the radical direction was set to 50 mT.

For the developer, the same developer as used in the previous experiments was used.

Images were formed under the foregoing conditions, and the output images were evaluated for each item.

For the evaluation of image density, a solid image was developed, and its density was measured using a light reflecting densitometer (commercial name: X-RITE310). If the measured value exceeds 1.8, both solid image and line image have sufficient density, and 1.8 or more was evaluated as "good", and under 1.8, as "bad".

Figure 5:
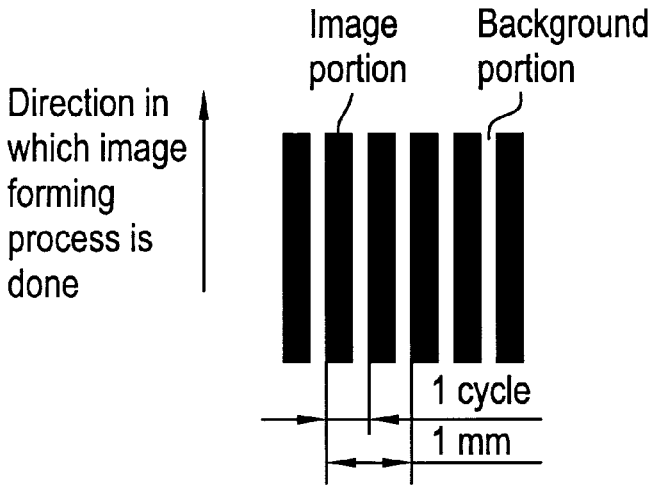
FIG. 5 is a view showing an image pattern used for investigating an amount of carrier of two-component developer transferred onto the image carrier during development.

As regards carrier adhesion, there was performed so-called development of alternating lines, in which such image portions and background portions as shown in FIG. 5 have been arranged in parallel at fixed periods in a direction perpendicular to the direction in which the process is done, and the carrier coverage at this time was measured for evaluation.

The period of the alternating lines is 2 cycles/mm, and the ratio of the image portion to the background portion is 1:1. In such alternating lines development, since there exists an electrostatic latent image on the surface of the photoreceptor, in which the image portions and the background portions are adjacent to each other at very small intervals, a so-called fringe electric field occurs in the vicinity of the surface of the photoreceptor layer, and an electrostatic attracting force acts on carrier charged oppositely in polarity to toner in the peripheral portion of the image. Therefore, the alternating lines are an image easy for carrier to adhere to, and is suitable for evaluation of carrier adhesion.

As the evaluation index for carrier coverage, an area factor of the carrier particles on the background portion of the alternating lines was used. In order to measure the area factor, an image analyzing device (commercial name: LUZEX-5000) was used, and if the area factor for the carrier particles is 1.0% or less, it is a level at which there is no problems in the practical use, and therefore, 1.0% or less was regarded as "good", and when 1.0% was exceeded, it was regarded as "bad".

As regards the uniformity of an image in the low density portion, a dot image having an area factor of 20% was evaluated by visual inspection, and a state in which infinitesimal density unevenness cannot be confirmed was regarded as "good", a level at which there is no problem in practical use although there is a small amount of infinitesimal density unevenness, as "acceptable", and a unusable level, as "bad".

As regards reproducibility of thin lines, the evaluation was performed in accordance with the same method as the previous experiments. The result of the experiment is shown in Table 2.

TABLE 2

| Thickness of conductive layer (μm) | Image density | | Carrier area factor (%) | | Uniformity in the low density portion | Thin line reproducibility | Overall evaluation |
|---|---|---|---|---|---|---|---|
| 1 | 1.96 | good | 0.10 | good | good | good | good |
| 2 | 1.96 | good | 0.23 | good | good | good | good |
| 3 | 1.96 | good | 0.43 | good | acceptable | acceptable | acceptable |

If the thickness of the conductive layer is 3 μm or less as shown in Table 2, it has been found that it is possible to obtain sufficient image density without causing carrier adhesion, and the uniformity of the low density portion and the reproducibility of thin lines become excellent.

The reason why the thickness of the conductive layer affects the uniformity of the low density portion and the reproducibility of thin lines in this way can be considered as follows:

As described above, the magnetic field caused by magnetic poles of the developer carrier attenuates and becomes weaker as it leaves the surface of the ferromagnetic material portion magnetized. For this reason, the larger is the thickness of the conductive layer formed on the portion magnetized, the larger the distance becomes between the portion magnetized and the carrier, and the magnetic constraint force acting on the carrier becomes weaker, and so-called omission, i.e., a portion to which the developer does not adhere, becomes prone to occur on the developer layer. Therefore, if the thickness of the conductive layer exceeds 3 μm, it will become difficult to cause the carrier to uniformly adhere on the developer carrier without causing any omission of the developer layer, and the uniformity of the low density portion and the reproducibility of thin lines deteriorate although it is not the level at which it is difficult to use in practice.

For the above-described reasons, the thickness of the conductive layer is preferably set to 3 μm or less, and such setting enables the uniformity of the low density portion and the reproducibility of thin lines to be enhanced.

In this respect, in this experiment, the developer carrier has been constructed so that a conductive layer is formed on the peripheral surface of the ferrite roll, but it is also possible to adopt another structure. It is possible to form, for example, a magnetic recording layer on a roll-shaped substrate, and to provide a conductive layer on top thereof. Also, it is possible to provide a bonding layer, a ground layer, a non-magnetic layer, an elastic layer or the like between the roll-shaped member of ferromagnetic material or the magnetic recording layer and the conductive layer, and even in a case where any of these layers is provided, the thickness between the surface of the magnetic layer magnetized and the surface of the developer carrier is set to 3 μm or less, whereby the same effect as the foregoing can be obtained.

Second Embodiment

Next, a description will be made of a developing device according to an embodiment of the invention.

<a. Structure and Operation of Developing Device>

Figure 6:
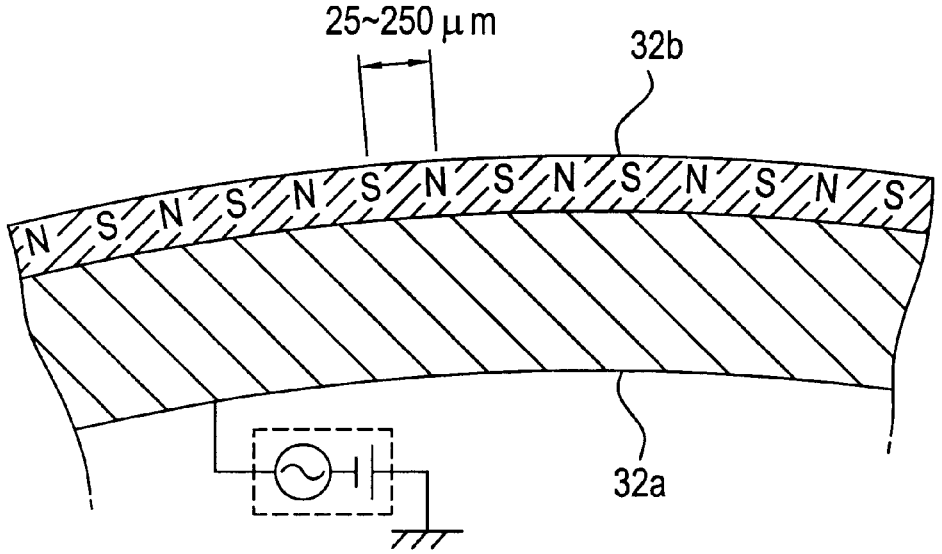
FIG. 6 is a schematic structural view showing a developing device according to an embodiment of the invention.

This developing device uses a developer carrier, the principal portion of which is composed of a cylindrical conductive substrate 32*a* and a magnetic recording layer 32*b* formed on the peripheral surface thereof as shown in FIG. 6 in place of the developer carrier 12 used in the developing device shown in FIG. 1. The other structure of this developing device is the same as in the developing device shown in FIG. 1.

The developer carrier 32 used for this developing device is set to 18 mm in outside diameter, 320 mm/s in peripheral speed during driving, and 300 μm in interval with the image carrier respectively, and is held so that the developer layer is in a non-contact state with the image carrier. Developing bias voltage is applied between the foregoing conductive substrate and the image carrier in such a manner that an electric field is formed between the developer carrier and the image carrier.

The foregoing magnetic recording layer 32*b* is constituted by coating the conductive substrate 32*a* with a product prepared by dispersing a powdered element of ferromagnetic material in binding resin to have a layer thickness of 50 μm, and is finished so that the surface roughness Rz thereof is 50 μm or less. In the developer carrier according to the present embodiment, for the foregoing ferromagnetic material, Ba ferrite is used, and for the binding resin, polyurethane is used. For the magnetic material, any material known as magnet material, magnetic recording material or the like, is usable, and $CrO_2$, $\gamma$-$Fe_2O_3$, Sr ferrite and the like can be used in addition to the foregoing Ba ferrite. For the binding resin, any material known as resin constituting a magnetic recording layer such as tape, disk and card is usable, and for example, polycarbonate, polyester and the like can be used in addition to the foregoing polyurethane.

The foregoing magnetic recording layer 32*b* is magnetized so that S-poles and N-poles are alternately arranged at equal intervals (25 to about 250 μm) in parallel over the entire circumference. This magnetization can be performed in the same manner as the magnetization of the developer carrier shown in FIG. 3, and magnetic poles having uniform intensity can be formed even if the magnetization is performed at infinitesimal intervals as described above because the surface of the magnetic recording layer has been smoothly finished (Rz≧50 μm) on magnetizing.

In such a developing device, when developer is supplied to the developer carrier 32, a fixed amount of developer is attracted onto the peripheral surface of the developer carrier 32 on the basis of the magnetic field of magnetic poles magnetized on the magnetic recording layer 32*b*. More specifically, only substantially one layer of carrier, which has electrically attracted toner, enters a substantially uniformly adhered state, and a developer layer is formed without the aid of any layer regulating member. Thus, this developer layer is conveyed to the development area opposite to the image carrier 1 with the rotation of the developer carrier 32 to be used for development of an electrostatic latent image on the image carrier.

<d. Experiments for Investigating Effects of Thickness of Magnetic Recording Layer on Image Density, Carrier Adhesion, Uniformity of Image in Low Density Portion, and Thin Line Reproducibility>

In these experiments, there were conducted, in a developing device using the developer carrier shown in FIG. 6, image formation by varying the thickness of the magnetic recording layer of the developer carrier, to investigate the image density, the adhesion of carrier, the uniformity of the image in the low density portion and the reproducibility of the thin lines.

In these experiments, the magnetic pole interval on the surface of the developer carrier was set to 100 μm, the magnetic flux density on the surface of the developer carrier in the radical direction was set to 50 mT, and there were used four types of developer carriers in which only the thickness of the magnetic recording layer was varied to 50 μm, 100 μm, 200 μm and 300 μm.

Images were formed under the foregoing conditions, and the effects on the image density, the adhesion of carrier, the uniformity of the image in the low density portion and the reproducibility of the thin line image for the output images were evaluated in accordance with the same method as in the experiments conducted for the developing device according to the first embodiment respectively. These results are shown in Table 3.

In this Table, for the overall evaluation, one which has no "acceptable" or "bad" in all of the foregoing four items is regarded as "good", one which has "acceptable", but no "bad" is regarded as "acceptable", and one which has even a single "bad" is regarded as "bad".

TABLE 3

| Thickness of magnetic recording layer (μm) | Image density | | Carrier area factor (%) | | Uniformity of low density portion | Reproducibility of thin lines | Overall evaluation |
|---|---|---|---|---|---|---|---|
| 50 | 1.96 | good | 0.10 | good | good | good | good |
| 100 | 1.96 | good | 0.11 | good | good | good | good |
| 200 | 1.95 | good | 0.09 | good | good | good | good |
| 300 | 1.95 | good | 0.10 | good | acceptable | acceptable | acceptable |

From Table 3, it will be seen that if the thickness of the magnetic recording layer 32*b* is 200 μm or less, sufficient image density can be obtained without causing any carrier adhesion and the uniformity of the low density portion and the reproducibility of the thin lines become excellent.

The reason why the thickness of the magnetic recording layer affects the uniformity of the low density portion and the reproducibility of thin lines in this way could be considered as follows:

As described above, developing bias voltage is applied to the conductive substrate 32*a* of the developer carrier, and the binding resin contained in the magnetic recording layer 32*b* has high resistance. Therefore, the larger is the thickness of the magnetic recording layer, the larger the distance becomes between the conductive substrate and the image carrier, and the effective development field becomes weaker. For this reason, it becomes difficult to sufficiently cause the foregoing reciprocating motion of toner, and as a result, the uniformity of the low density portion having comparatively weak development field and the reproducibility of thin lines deteriorate.

For the foregoing reason, if the thickness of the magnetic recording layer in the foregoing experimental conditions exceeds 200 μm, the uniformity of the low density portion and the reproducibility of thin lines deteriorate although it is not a level at which it is difficult to use in practice. In contrast, the thickness of the magnetic recording layer is set to 200 μm or less, whereby it is possible to enhance the uniformity of the low density portion and the reproducibility of thin lines by causing toner to sufficiently reciprocate by the action of the development field.

In this respect, although the magnetic pole interval was set to 100 μm in this experiment, the similar result can be obtained if the magnetic pole interval is within a range of 25 μm to 250 μm.

In order to reduce the resistance of the magnetic recording layer, it is also possible to add conductive finely divided particles thereto. In this case, it becomes possible to further cause a sufficient development field to act.

In the present embodiment, the developer carrier was constituted of the conductive substrate 32*a* and the magnetic recording layer 32*b*, but it is also possible to adopt another structure. It is possible to provide a conductive layer on a non-conductive substrate and on top thereof, form a magnetic recording layer. Further, a protective layer, a wear-resistant layer or the like may be provided on the peripheral surface of the magnetic recording layer 32*b*, and a bonding layer, a ground layer, a non-magnetic layer, an elastic layer or the like may be provided between the conductive substrate or the conductive layer and the magnetic recording layer. In this respect, even in a case where any of these layers has been provided, the similar effect to the foregoing can be obtained if the spacing between the surface of the conductive substrate or the conductive layer and the surface of the developer carrier is set to 200 μm or less.

Third Embodiment

Next, a description will be made of a developing device according to an embodiment of the invention.

This developing device uses a roll-shaped member integrally formed of conductive magnetic material as the developer carrier. For this conductive magnetic material, Mg—Al is adopted, and its peripheral surface is so smoothly finished that the surface roughness Rz becomes 50 μm or less. A plurality of N-poles and S-poles are alternately arranged in the vicinity of the peripheral surface of the magnet roll thus formed. The other structure of this developing device is the same as in the developing device according to the first embodiment shown in FIG. 1.

When, using such a developing device, experiments for investigating the image density, the adhesion of carrier and the uniformity of image density have been conducted by varying the type of carrier and the magnetic pole interval of the foregoing developer carrier, then sufficient image density was obtained without causing adhesion of carrier to the image carrier and defective uniformity of image density irrespective of the carrier if the magnetic pole interval is within a range of 25 μm to 250 μm. In this respect, four types of carrier shown in Table 4 have been used for this experiment.

TABLE 4

| Type of carrier | Average particle diameter (μm) | True density ($g/cm^3$) | Magnetization per unit weight ($A.m^2/kg$) ($A.m^2/kg$) |
|---|---|---|---|
| (1) | 50 | 2.2 | 40 |
| (2) | 100 | 2.2 | 40 |
| (3) | 50 | 4.5 | 50 |
| (4) | 100 | 4.5 | 50 |

Types (1) and (2) of carriers in Table 4 are magnetic powder dispersion resin carrier, and (3) and (4) are ferrite carrier. Also, the average particle diameter is weight-average particle diameter. The magnetization is magnetization per unit weight in a magnetic field of $10^6/(4\pi)$A/m, and the residual magnetization is under 5 kA/m for all carriers.

The mixing ratio of toner to carrier in the developer is the weight ratio of toner in the developer, and it is set to 15 wt. % in carriers of (1) and (2), and 7.9 wt. % in carriers of (3) and (4) so that they have the substantially same amount of toner per unit volume. Also, the amount of toner charge is adjusted within a range of −15 mC/kg to −20 mC/kg.

In this respect, in a developer carrier used for a developing device according to the present embodiment, Mg—Al was used for the conductive magnetic material, and if developing bias can be applied and a residual magnetization pattern can be formed, other materials such as Al—Ni—Co and Fe—Cr—Co can be used.

In the present embodiment, the developer carrier was integrally formed using conductive magnetic material, and constitution may be made such that conductive magnetic material is stacked on a conductive or insulating substrate. In this case, as the conductive magnetic material, any material known as magnet material or magnetic recording material can be used in addition to the foregoing Mg—Al, Al—Ni—Co, Fe—Cr—Co and the like, and for example, Co—Ni—P, Co—Ni, Co—Cr and the like can be used.

Further, this developer carrier may be constituted such that a protective layer, a wear-resistant layer or the like is provided on the conductive magnetic material. In this respect, in a case where any of these layers is provided, the distance between the surface of the conductive magnetic portion and that of the developer carrier is preferably 3 μm or less in order to make the uniformity of the low density portion and the reproducibility of thin lines excellent.

Effect of the Invention

As described above, in a developing device according to the present invention, since the structure is arranged such that the surface roughness Rz at a portion of the developer carrier where a plurality of magnetic poles are provided at infinitesimal intervals is 50 μm or less, uniform magnetic poles can be magnetized at as infinitesimal intervals as 25 μm to about 250 μm in the vicinity of the peripheral surface of the developer carrier. The developer carrier thus magnetized is capable of forming a developer layer having substantially one layer of carrier closely arranged on the peripheral surface thereof without the aid of any layer regulating member, and forming a high-quality image in uniform density. In addition, since the formation of the developer layer is performed only by a magnetic force, deterioration of the developer during the formation of the layer is prevented to enable high image quality to be stably obtained.

What is claimed is:

1. A developing device, comprising a developer carrier, provided to face an image carrier on whose surface an electrostatic latent image is formed, and supported in such a manner that the peripheral surface can rotate, for applying developing bias voltage between said developer carrier and said image carrier, and transferring toner from two-component developer containing toner and magnetic carrier, carried on the peripheral surface of said developer carrier, onto said image carrier to thereby form a toner image, wherein said developer carrier is constituted of magnetic material in the vicinity of the peripheral surface thereof, and the surface roughness of the peripheral surface of the portion constituted of said magnetic material is 50 μm or less.

2. The developing device according to claim 1, wherein said magnetic material is ferromagnetic material.

3. The developing device according to claim 1, wherein said magnetic material is a magnetic recording layer.

4. The developing device according to claim 1, wherein N-poles and S-poles on said magnetic material are alternately magnetized over the entire circumference of said developer carrier, and the center-to-center spacing between an N-pole and an S-pole which are adjacent to each other on said developer carrier is from 25 μm to 250 μm.

5. The developing device according to claim 1, wherein the surface roughness on the peripheral surface of a portion constituted of said magnetic material is 1 μm or less, and a conductive layer with a thickness of 3 μm or less is stacked on top of said peripheral surface.

6. The developing device according to claim 3, wherein said magnetic recording layer is formed on the peripheral surface of a roll-shaped member formed of conductive material.

7. The developing device according to claim 3, wherein the thickness of said magnetic recording layer is 200 μm or less.

8. The developing device according to claim 6, wherein the thickness of said magnetic recording layer is 200 μm or less.

9. The developing device according to claim 1, wherein said magnetic material possesses electrical conductivity.

10. A developing method for developing an electrostatic latent image on an image carrier using two-component developer containing toner and magnetic carrier, comprising the steps of:

supplying said two-component developer to a peripheral surface of a developer carrier, which is constituted of magnetic material in the vicinity of said peripheral surface, the surface roughness of said peripheral surface being 50 μm or less, and is rotatably supported;

applying developing bias voltage between said developer carrier and said image carrier; and transferring toner from said two-component developer supplied to said peripheral surface of said developer carrier to said image carrier to form a toner image.

11. The developing method according to claim 10, wherein said magnetic material is ferromagnetic material.

12. The developing method according to claim 10, wherein said magnetic material is a magnetic recording layer.

13. The developing method according to claim 10, wherein N-poles and S-poles on said magnetic material are alternately magnetized over the entire circumference of said developer carrier, and the center-to-center spacing between an N-pole and an S-pole which are adjacent to each other on said developer carrier is from 25 μm to 250 μm.

14. The developing method according to claim 10, wherein the surface roughness on the peripheral surface of a portion constituted of said magnetic material is 1 μm or less, and a conductive layer with a thickness of 3 μm or less is stacked on top of said peripheral surface.

15. The developing method according to claim 12, wherein said magnetic recording layer is formed on the peripheral surface of a roll-shaped member formed of conductive material.

16. The developing method according to claim 12, wherein the thickness of said magnetic recording layer is 200 μm or less.

17. The developing method according to claim 15, wherein the thickness of said magnetic recording layer is 200 μm or less.

18. The developing method according to claim 10, wherein said magnetic material possesses electrical conductivity.

* * * * *